US008844742B2

(12) United States Patent
Fujita et al.

(10) Patent No.: US 8,844,742 B2
(45) Date of Patent: Sep. 30, 2014

(54) BEVERAGE CONTAINER

(71) Applicants: Thermos K.K., Tsubame (JP); Thermos L.L.C., Schaumburg, IL (US)

(72) Inventors: Mamoru Fujita, Tsubame (JP); Shin Matsuyama, Tsubame (JP)

(73) Assignees: Thermos K.K. (JP); Thermos L.L.C., Schaumburg, IL (US)

( * ) Notice: Subject to any disclaimer, the term of this patent is extended or adjusted under 35 U.S.C. 154(b) by 0 days.

(21) Appl. No.: 13/735,145

(22) Filed: Jan. 7, 2013

(65) Prior Publication Data

US 2013/0175270 A1 Jul. 11, 2013

(30) Foreign Application Priority Data

Jan. 10, 2012 (JP) ..... 2012-002497

(51) Int. Cl.
*B65D 51/16* (2006.01)
*B65D 47/20* (2006.01)
*A47G 19/22* (2006.01)

(52) U.S. Cl.
CPC ..... *B65D 51/1644* (2013.01); *B65D 47/2031* (2013.01); *A47G 19/2266* (2013.01)
USPC ..... 220/203.01; 220/714; 220/707; 220/703; 220/367.1; 215/388; 215/311; 215/307; 239/571; 239/569; 239/33

(58) Field of Classification Search
USPC ..... 215/307, 309, 311, 388; 220/367.1, 220/703, 705–709, 714, 202–203.01; 222/189.1, 544, 556–557, 562, 222/566–568; 239/33, 569–571
See application file for complete search history.

(56) References Cited

U.S. PATENT DOCUMENTS 1,556,732 A * 10/1925 Sterrick ..... 137/140
1,813,285 A * 7/1931 Galetschky ..... 239/33
2,153,156 A * 4/1939 Pollnow ..... 222/180
2,948,453 A * 8/1960 Drown ..... 229/103.1

(Continued)

FOREIGN PATENT DOCUMENTS

JP S57-36139 2/1982
JP 2004345742 12/2004
WO WO 9414400 A1 * 7/1994

OTHER PUBLICATIONS

Japanese Office Action dated Apr. 16, 2013 (5 pages).

*Primary Examiner* — Mickey Yu
*Assistant Examiner* — Brijesh V. Patel
(74) *Attorney, Agent, or Firm* — Polsinelli PC

(57) ABSTRACT

A drinking mouth portion pointing upward is provided on a plug body of a container main body having a sealed structure. A down-pointing beverage cylindrical member is built into the container main body and has a front edge side thereof communicated with the drinking mouth portion. Provided inside a fluid passage of the beverage cylindrical member is a valve movable in accordance with a pressure difference therein. The valve is not manually opened and closed, but reacts to a suction force in the fluid passage. An up-pointing cut-out section is provided on a lower edge of the beverage cylindrical member, thus allowing one to drink up a content fluid remaining in an inner bottom section. Therefore, a relatively small number of additional parts are needed to address the spewing of a content fluid and the occurrence of a residual liquid at the time of opening the drinking mouth portion.

10 Claims, 6 Drawing Sheets

(56) References Cited

U.S. PATENT DOCUMENTS

| | | | | | |
|---|---|---|---|---|---|
| 3,438,527 | A | * | 4/1969 | Gamblin, Jr. | 215/388 |
| 3,610,483 | A | * | 10/1971 | Visconti et al. | 222/478 |
| 4,095,615 | A | * | 6/1978 | Ramsauer | 137/527.8 |
| 4,196,747 | A | * | 4/1980 | Quigley et al. | 137/527.8 |
| 4,485,963 | A | * | 12/1984 | Panicci | 229/103.1 |
| RE33,564 | E | * | 4/1991 | Ford, Jr. | 222/209 |
| 5,010,925 | A | * | 4/1991 | Atkinson et al. | 137/847 |
| 5,085,349 | A | * | 2/1992 | Fawcett | 220/703 |
| 5,213,236 | A | | 5/1993 | Brown et al. | |
| 5,301,845 | A | * | 4/1994 | Labonte | 222/211 |
| 5,337,918 | A | * | 8/1994 | Wang | 220/708 |
| 5,339,982 | A | * | 8/1994 | Tardie | 220/708 |
| 5,439,143 | A | * | 8/1995 | Brown et al. | 222/185.1 |
| 5,513,762 | A | * | 5/1996 | Janani | 215/229 |
| 5,560,513 | A | * | 10/1996 | Jarrell | 220/705 |
| 5,662,268 | A | * | 9/1997 | Katzenberger | 239/33 |
| 5,730,336 | A | * | 3/1998 | Lerner | 222/490 |
| 6,196,413 | B1 | * | 3/2001 | Tung | 220/709 |
| 6,273,128 | B1 | * | 8/2001 | Paczonay | 137/512.3 |
| 6,290,090 | B1 | * | 9/2001 | Essebaggers | 220/710 |
| 6,395,170 | B1 | * | 5/2002 | Hughes et al. | 210/232 |
| 6,523,711 | B1 | * | 2/2003 | Hughes et al. | 220/709 |
| 6,915,961 | B2 | | 7/2005 | Renz et al. | |
| 7,311,231 | B2 | * | 12/2007 | Noell et al. | 224/148.2 |
| 2002/0040909 | A1 | * | 4/2002 | Goto et al. | 220/709 |
| 2002/0158069 | A1 | * | 10/2002 | Yoneoka et al. | 220/254.3 |
| 2004/0011800 | A1 | * | 1/2004 | Essebaggers | 220/714 |
| 2005/0029271 | A1 | * | 2/2005 | McDonough | 220/709 |
| 2005/0092373 | A1 | | 5/2005 | Schafer et al. | |
| 2005/0133519 | A1 | | 6/2005 | McDonough | |
| 2005/0150894 | A1 | * | 7/2005 | Stribling et al. | 220/705 |
| 2006/0255169 | A1 | * | 11/2006 | Gieson | 239/33 |
| 2007/0108214 | A1 | * | 5/2007 | Maher | 220/708 |
| 2007/0262164 | A1 | * | 11/2007 | Gelfand | 239/33 |
| 2010/0127005 | A1 | * | 5/2010 | Sanbrook et al. | 220/705 |
| 2011/0049169 | A1 | * | 3/2011 | Rosnak et al. | 220/705 |
| 2012/0056008 | A1 | * | 3/2012 | Claessens | 239/33 |

* cited by examiner

BEVERAGE CONTAINER

BACKGROUND OF THE INVENTION

1. Field of the Invention

The present invention relates to a beverage container including a beverage cylindrical member.

2. Description of Related Art

Conventionally, there has been known a beverage container including: an up-pointing drinking mouth portion that is provided on a plug body of a container main body having a sealed structure; a lid that covers the drinking mouth portion and is pivotally provided on the plug body; and a down-pointing beverage cylindrical member that has a front edge thereof communicated with the drinking mouth portion and is built into the container main body. The aforementioned beverage container has a problem of, for example, causing a content fluid to spew out of the drinking mouth portion through the beverage cylindrical member when an inner pressure of the container main body is higher than the atmospheric pressure at the time of opening the lid so as to start to drink the content fluid.

In order to solve such problem, there has been disclosed a beverage container (Japanese Unexamined Patent Application Publication No. 2004-345742) allowing an aeration hole thereof to be opened and closed through, for example, a pivotal motion of a lever disposed separately from a lid and a motion of a sliding member. Specifically, the aeration hole is closed, opened and then closed by manipulating the lever, thereby releasing an inner pressure and eliminating a displacement between a content fluid and air in a beverage cylindrical member, thus eliminating the splashing of the content fluid from a drinking mouth portion.

Further, there has also been disclosed a dispensing valve for packaging (U.S. Pat. No. 5,213,236) that is to be attached to an opening section of a fluid container. This valve can be turned into an opened state when deformed by, for example, squeezing the fluid container, thus allowing a content fluid to be spewed out before the corresponding valve is turned into a closed state with no pressure being applied to the fluid container any longer.

SUMMARY OF THE INVENTION

According to the conventional technique, an opening section of a beverage container is inevitably formed small due to a shape of the beverage container. Thus, when opening a lid to drink a content fluid, unless a pressure of an inner air space is released, an inner pressure may cause the content fluid to spew out of a beverage cylindrical member that is inserted in a deep portion of the content fluid, i.e., down to a bottom section side of the beverage container. Therefore, with regard to a beverage container having a beverage cylindrical member and a sealed structure, efforts have been made in general to reduce the inner pressure before opening the opening section, i.e., a drinking mouth, by opening an aeration hole communicated with the air space.

Further, the content fluid may also spew out of the drinking mouth as follows, when opening a beverage container having a beverage cylindrical member. That is, while the drinking mouth is remaining closed, if the aeration hole is opened, but not closed after reducing the inner pressure, the content fluid will be displaced into the beverage cylindrical member when there are air and the content fluid remaining in the beverage cylindrical member. As a result, the content fluid originally remaining in the beverage cylindrical member may spew out of the drinking mouth when opening the corresponding drinking mouth.

Accordingly, in order to eliminate the splashing of a content fluid from a drinking mouth, efforts have also been made to allow a drinking mouth of a beverage container having a beverage cylindrical member to be opened, after an aeration hole is closed, opened and then closed again with the drinking mouth remaining closed.

Here, a plug body may fail to be attached to a beverage container if a beverage cylindrical member fails to appropriately come into contact with an inner bottom section of the corresponding beverage container. Specifically, such failure occurs when the beverage cylindrical member to be installed in the beverage container is made of a hard material, accompanied by problems such as an incomplete installation and/or a variation in the size of the beverage container. Further, the aforementioned failure also occurs when the inner bottom section of the beverage container is made of a hard material, accompanied by the problems such as the incomplete installation and/or the variation in the size of the beverage container. While a clearance of a certain size needs to be provided between the beverage cylindrical member and the inner bottom section of the beverage container, such clearance may make it impossible for one to drink up the content fluid in the beverage container if provided inappropriately.

With regard to a beverage container having a beverage cylindrical member and a sealed structure, problems to be solved include the spewing of a content fluid and the occurrence of a residual liquid at the time of opening a drinking mouth portion. It is an object of the present invention to solve the aforementioned problems with a relatively small number of additional parts.

A beverage container of a first aspect of the present invention, includes: a drinking mouth portion that is provided on a plug body of a container main body having a sealed structure; a beverage cylindrical member that is communicated with the drinking mouth portion and built into the container main body, the beverage cylindrical member pointing downward; and a valve member that is provided on a fluid passage of the beverage cylindrical member and movable in accordance with a pressure difference.

A beverage container of a second aspect of the present invention is based on the beverage container of the first aspect. According to the beverage container of the second aspect, the valve member includes a positioning step section in a portion where a cylindrical main body of the beverage cylindrical member is allowed to engage therewith.

A beverage container of a third aspect of the present invention is based on the beverage container of the first aspect. According to the beverage container of the third aspect, the valve member includes a cut-out section provided on a lower edge thereof.

A beverage container of a fourth aspect of the present invention is based on the beverage container of the second aspect. According to the beverage container of the fourth aspect, the valve member further includes a cut-out section provided on a lower edge thereof.

A beverage container of a fifth aspect of the present invention is based on the beverage container of the first aspect. According to the beverage container of the fifth aspect, the valve member includes a membrane valve composed of a membrane closing the fluid passage and having a cut formed thereon.

A beverage container of a sixth aspect of the present invention is based on the beverage container of the second aspect. According to the beverage container of the sixth aspect, the valve member further includes a membrane valve composed of a membrane closing the fluid passage and having a cut formed thereon.

A beverage container of a seventh aspect of the present invention is based on the beverage container of the third aspect. According to the beverage container of the seventh aspect, the valve member further includes a membrane valve composed of a membrane closing the fluid passage and having a cut formed thereon.

A beverage container of an eighth aspect of the present invention is based on the beverage container of the fourth aspect. According to the beverage container of the eighth aspect, the valve member further includes a membrane valve composed of a membrane closing the fluid passage and having a cut formed thereon.

A beverage container of a ninth aspect of the present invention is based on the beverage container of the fifth aspect. According to the beverage container of the ninth aspect, the membrane of the valve member is configured into a concave shape when the valve member is joined to the beverage cylindrical member, and the cut is formed in a concaved section of the membrane.

A beverage container of a tenth aspect of the present invention is based on the beverage container of the sixth aspect. According to the beverage container of the tenth aspect, the membrane of the valve member is configured into a concave shape when the valve member is joined to the beverage cylindrical member, and the cut is formed in a concaved section of the membrane.

A beverage container of an eleventh aspect of the present invention is based on the beverage container of the seventh aspect. According to the beverage container of the eleventh aspect, the membrane of the valve member is configured into a concave shape when the valve member is joined to the beverage cylindrical member, and the cut is formed in a concaved section of the membrane.

A beverage container of a twelfth aspect of the present invention is based on the beverage container of the eighth aspect. According to the beverage container of the twelfth aspect, the membrane of the valve member is configured into a concave shape when the valve member is joined to the beverage cylindrical member, and the cut is formed in a concaved section of the membrane.

According to the invention described in the first aspect, the spewing of a beverage from the beverage container can be restricted at the time of opening the lid, even when the pressure is being applied. The valve is not manually opened and closed, but is configured to be able to react to a suction force occurring in the fluid passage. Therefore, only a relatively small number of additional parts are needed to solve a problem such as the spewing of a content fluid that occurs at the time of opening the drinking mouth. Further, since the valve member is detachable, it has a favorable washability.

According to the invention described in the second aspect, the positioning step section allows the cylindrical main body to be precisely positioned to and then inserted into a cylindrical portion, without causing the corresponding cylindrical main body to be excessively inserted into the cylindrical portion.

According to the inventions described in the third and fourth aspects, the cut-out section provided on the lower edge allows one to drink up a residual liquid through a simple structure.

According to the inventions described in the fifth aspect through the eighth aspect, the shape of the membrane valve can be easily formed.

According to the inventions described in the ninth aspect through the twelfth aspect, the membrane when configured into the concave shape is stronger against a pressure applied, thus making it difficult for the beverage to spew out.

DETAILED DESCRIPTION OF THE INVENTION

Figure 1:
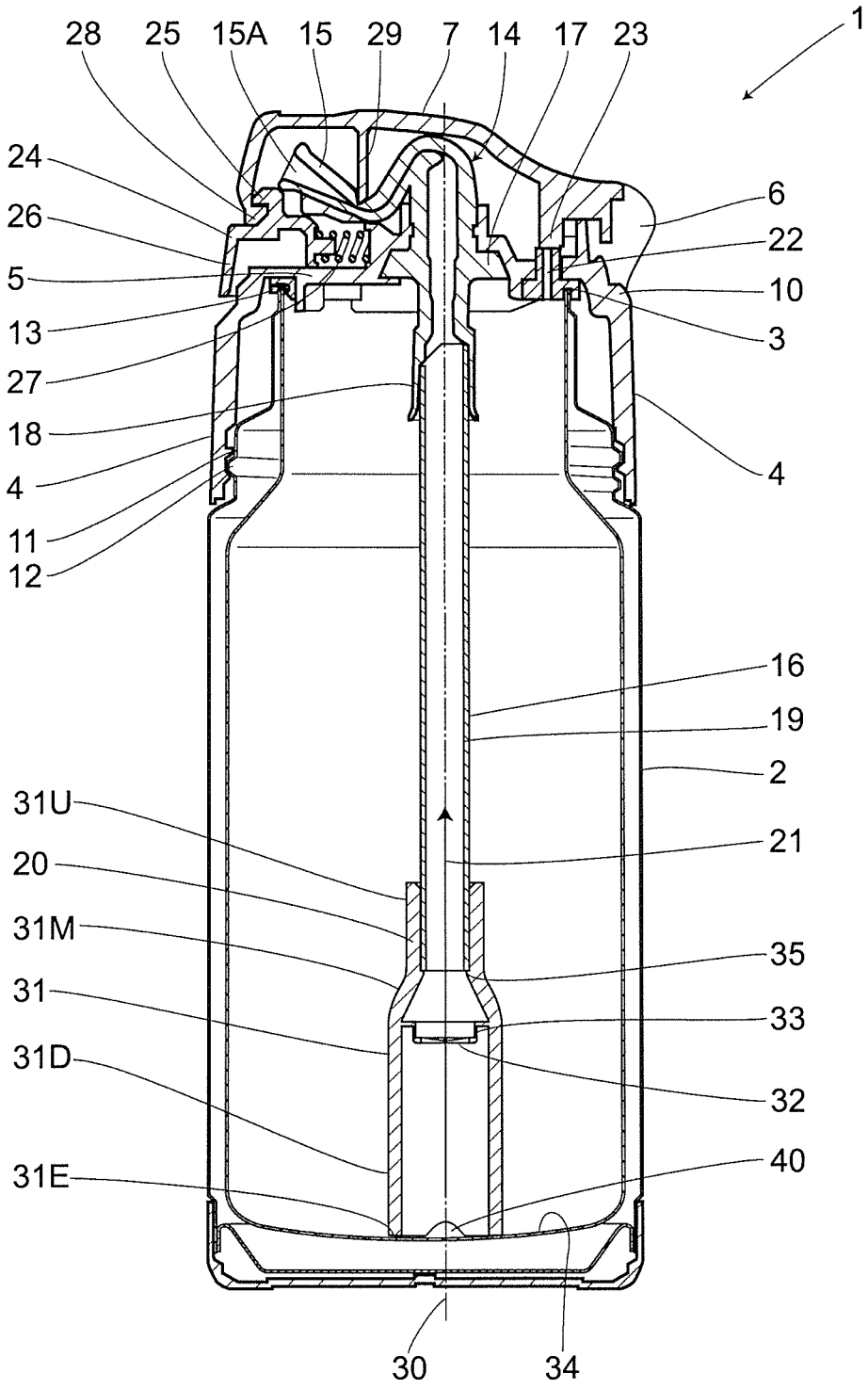
FIG. 1 is a vertical cross-sectional view showing a first embodiment of the present invention.

Preferable embodiments of the present invention are described hereunder with reference to the accompanying drawings. However, the embodiments described hereunder shall not limit the contents of the present invention that are described in the claims. Further, not all elements described hereunder are necessarily the essential elements of the present invention.

First Embodiment

In FIG. 1 through FIG. 7, a numerical symbol "1" represents, as a whole, a portable beverage container of the present invention. The beverage container 1 has a sealed structure, and includes: a metallic container main body 2; and a plug body 4 that is made of a synthetic resin and joined to a container opening 3 of the container main body 2. An openable cup-shaped lid 7 is provided on the plug body 4 through a hinge member 6 attached to a one end side of a top section 5 of the plug body 4. Here, the lid 7 is capable of being held in a closed state through a locking mechanism 24 provided on an opposite side of the hinge member 6.

The plug body 4 includes a plug main body 10 of an inverted bottomed cylindrical shape. Particularly, the plug main body 10 is provided with the aforementioned top section 5 covering an upper opening section of the container main body 2. Further, a female screw portion 11 formed on an inner circumferential surface of the plug main body 10, is allowed to be screwed together with a cylindrical male screw portion 12 provided on an upper outer circumferential surface of the container main body 2.

Provided on a rear surface of the plug main body 10 is an annular liquid-tight sealing member 13 that is made of an elastic material such as a silicon rubber, an elastomer resin or the like, and allows a top section of the container opening 3 to abut thereagainst.

A beverage straw unit 14 for use in drinking a content fluid (not shown), includes: a drinking mouth portion or drinking nozzle portion 15 that is provided above the top section 5 and has a drinking mouth or drinking nozzle 15A as an end section; and a beverage cylindrical member or beverage tube member 16 that is provided below the top section 5, communicated with the drinking mouth portion 15 and built into the aforementioned container main body 2. Provided on a base side of the drinking mouth portion 15 are: a positioning section 17 that is positioned to and engaged with an under surface side of the top section 5; and a cylindrical widening section 18 extending downward from the positioning section 17, the widening section 18 being joined to the beverage cylindrical member 16. With regard to the beverage cylindrical member 16, an upper end of a cylindrical main body 19 is detachably fitted in the widening section 18. Further, joined to a lower end of the cylindrical main body 19 is a valve unit 20 with a later-described valve built therein.

Here, a drinking mouth portion 15 side is, as a whole, made of an elastic material such as a silicon rubber, an elastomer resin or the like. While the drinking mouth portion 15 side has a moderate strength, it is capable of being slightly deformed when subjected to an external force.

Therefore, a user is allowed to turn the lid 7 into an opened state, and then put into his/her mouth the drinking mouth 15A of the drinking mouth portion 15 exposed from an outer surface of the plug main body 10, thereby making it possible to suck in and drink a beverage in the container main body 2 through a fluid passage 21 ranging from a lower end of the valve unit 20 to the drinking mouth portion 15.

In addition to the aforementioned structure, a protruding aeration portion 22 is provided on a hinge member 6 side of the plug body 4. Specifically, air is allowed to flow into the container main body 2 through such protruding aeration portion 22, depending on an amount of the beverage being sucked from the drinking mouth portion 15. Thus, the beverage in the container main body 2 can be easily sucked from the drinking mouth portion 15. Here, the lid 7 is provided with a sealing protrusion 23 serving to seal an upper end of the protruding aeration portion 22 when the lid 7 is in the closed state.

Further, the locking mechanism 24 of the lid 7 is provided on the opposite side of the hinge member 6 on the top section 5 of the plug main body 10. The locking mechanism 24 includes a locking button 26 and a resilient member 27. Specifically, the locking button 26 is provided on the top section 5 of the plug main body 10 in a manner such that the locking button 26 can be slid toward a center section side of the plug main body 10. Further, the locking button 26 has an engageable part 25 that is formed on an outer circumferential side of the plug main body 10 and into an "L" shape when viewed cross-sectionally. Meanwhile, the resilient member 27 is composed of, for example, a compression coil spring constantly biasing the locking button 26 toward the outer circumferential side of the plug main body 10.

Accordingly, once the lid 7 has been turned into the closed state through the hinge member 6, the locking mechanism 24 serving as an engagement portion will allow the engageable part 25 of the locking button 26 to engage with an engagement receiving part 28 formed on the lid 7 and also into an "L" shape when viewed cross-sectionally, thereby making it possible to maintain a fully-closed state of the lid 7. At that time, the drinking mouth portion 15 is bent into an "S" shape through two locations, by a plate-shaped protrusion 29 extending downward from a rear surface of the lid 7. Therefore, not only the drinking mouth portion 15 can be received in an inner space of the lid 7, but the beverage can be prevented from leaking out of the drinking mouth portion 15 by squashing the fluid passage 21 of the corresponding drinking mouth portion 15.

The aforementioned valve unit 20 provided on the fluid passage 21 is described hereunder. The valve unit 20 includes a cylindrical portion 31, a membrane 32 and a joining cylindrical portion (connector sleeve) 33. Specifically, the cylindrical portion 31 serves as a casing that is coaxially joined to and communicated with the cylindrical main body 19 through a central axis line 30 thereof. The membrane 32 is orthogonal to the central axis line 30 such that the fluid passage 21 can be blocked thereby. Further, the membrane 32 serves as a valve, and is opened due to a difference in pressure inside the fluid passage 21. The joining cylindrical portion 33 is provided between an inner circumference of the cylindrical portion 31 and an outer edge of the membrane 32. The joining cylindrical portion 33 allows the membrane 32 to be configured into a concave shape inside the cylindrical portion 31.

An upper section of the cylindrical portion 31 can be fitted onto and thereby joined to the lower end of the cylindrical main body 19. An outer diameter of a lower section 31D of the cylindrical portion 31 is formed larger than an outer diameter of an upper section 31U thereof. Further, there is provided a lower edge 31E capable of coming into contact with an inner bottom section 34 of the container main body 2 when attached thereto. An intermediate section 31M located between the upper section 31U and the lower section 31D, is formed into the shape of a truncated cone whose diameter gradually enlarges downward. The membrane 32 is disposed inside a lower section that is slightly below a border between the lower section 31D and the intermediate section 31M. In addition, on an inner circumferential surface of the upper section 31U, there is formed a positioning step section 35 allowing the lower end of the cylindrical main body 19 to engage therewith.

The membrane 32 has a circular shape when viewed from the top. Specifically, a diameter of such planar shape of the membrane 32 is slightly smaller than that of an inner circumferential surface of the lower section 31D of the cylindrical portion 31. More specifically, the membrane 32 is integrally formed together with the cylindrical portion 31 and the joining cylindrical portion 33, through a rubber-like elastic material such as a silicon rubber, an elastomer resin or the like. Here, the membrane 32 and the joining cylindrical portion 33 are in the forms of thin sheets (or films), in which a first wall thickness A is formed smaller than a second wall thickness B of the cylindrical portion 31 (A<B). Further, on the membrane 32, there is formed a cut (slit) 36 capable of communicating upper and lower sides thereof with each other. Particularly, the cut 36 is arranged radially around the central axis line 30 such that a plurality of valve-divided sections 37 can also be arranged radially around the central axis line 30. With regard to wall thicknesses of the valve-divided sections 37 in a vertical direction, a third wall thickness C formed around the central axis line 30 is smaller than a fourth wall thickness D formed outside of where the third wall thickness C is formed. Specifically, the third wall thickness C is formed as a result of the fourth wall thickness D being gradually smaller toward the central axis line 30 (C<D). When viewed from the top, the cut 36 may, for example, be formed into the shape of a cross, the shape of a straight line, a "Y" shape or the shape of an asterisk. As an after processing, the corresponding cut is often made with a significantly sharp blade after an elastic member is formed.

Further, the joining cylindrical portion 33 is integrally provided between an inner circumferential surface of a lower section of the cylindrical portion 31 and the outer edge of the membrane 32. Thus, the membrane 32 is allowed to easily react to the difference in pressure inside the fluid passage 21, in the cylindrical portion 31. The joining cylindrical portion 33 is so disposed that a central axis line thereof is identical to the central axis line 30. While a lower end of the joining cylindrical portion 33 is joined to the outer edge of the membrane 32, an upper end thereof is joined to an inner circumference of a flange section 38 that has an annular shape when viewed from the top. Here, an outer circumference of the flange section 38 is joined to an inner circumference of the border between the lower section 31D and the intermediate section 31M.

On a lower end of the beverage cylindrical member 16, i.e., the lower edge 31E of the cylindrical portion 31 in the present embodiment, there is provided an up-pointing cut-out section 40 allowing inner and outer sides of the cylindrical portion 31 to be communicated with each other along a circumferential direction thereof.

Functions brought about by the aforementioned structure are described hereunder. As shown in FIG. 1, the plate-shaped protrusion 29 serves to bend the drinking mouth portion 15 into the "S" shape through two locations when the lid 7 is in the closed state where the beverage is contained in the container main body 2, thereby allowing the drinking mouth portion 15 to prevent the beverage from leaking out. At that time, a front edge of the sealing protrusion 23 is pressed against a front edge of the protruding aeration portion 22. By pressing the locking button 26, the engagement receiving part 28 will be disengaged from the engageable part 25, thus allowing the lid 7 to be opened through the hinge member 6, and the drinking mouth portion 15 to stand and be opened as well. Here, the protruding aeration portion 22 is opened as a result of opening the lid 7, thus allowing a pressure inside the container main body 2 to be that of the atmospheric pressure.

Figure 4:
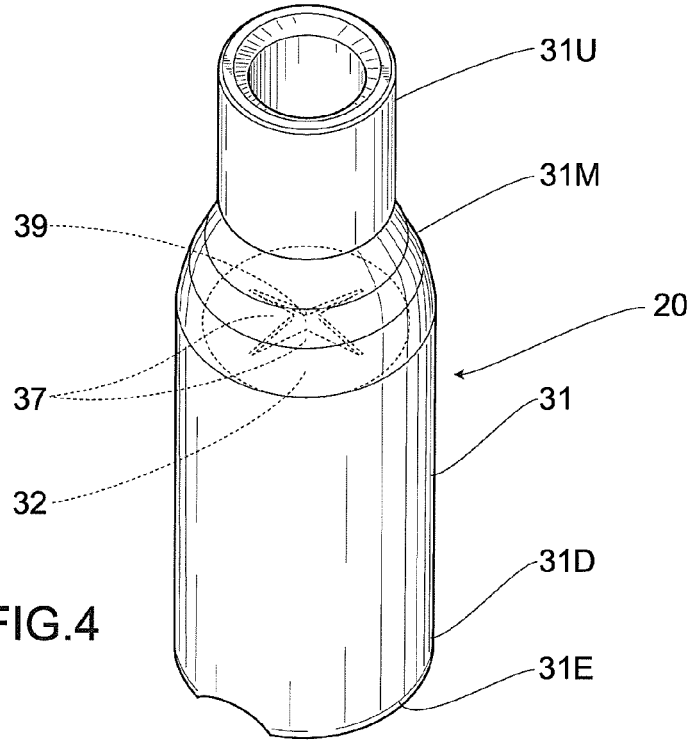
FIG. 4 is an enlarged perspective view showing the main portion of the first embodiment whose valve is opened.
Figure 5:
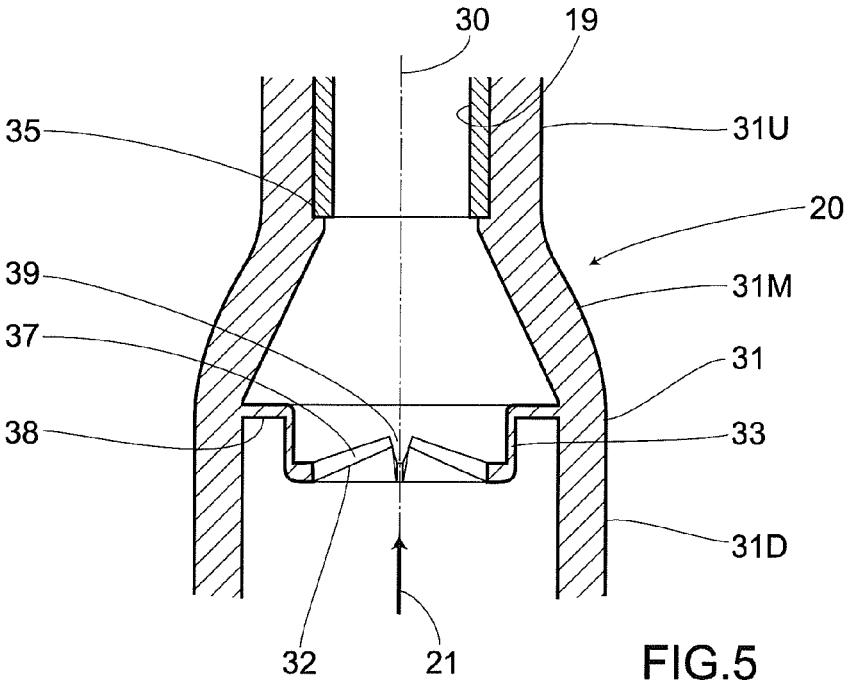
FIG. 5 is an enlarged cross-sectional view showing the main portion of the first embodiment whose valve is opened.
Figure 6:
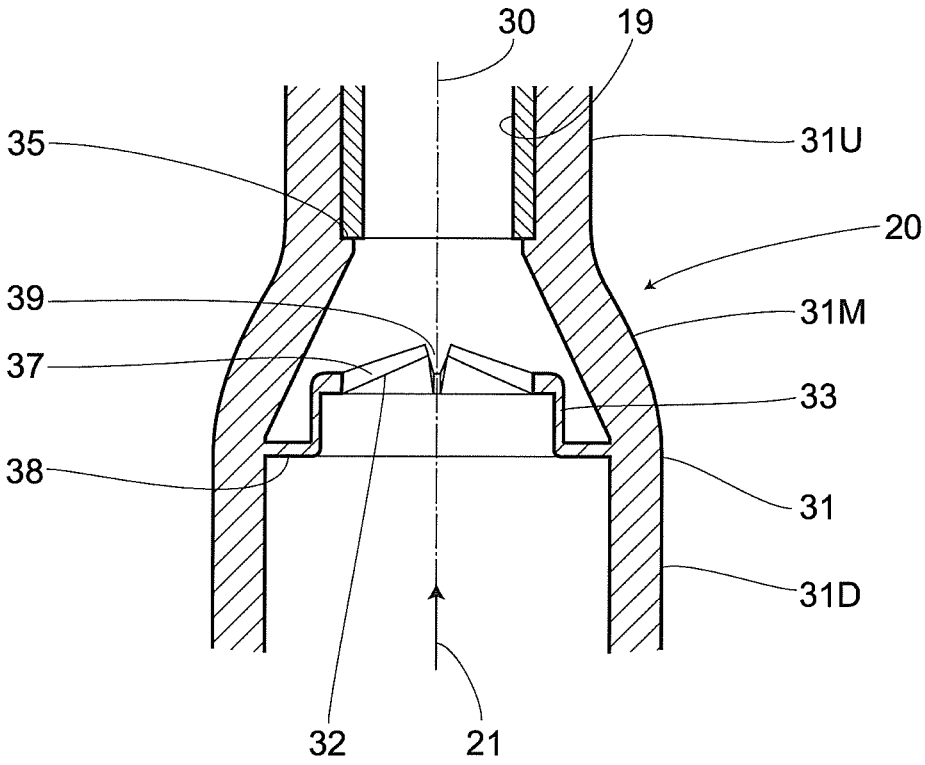
FIG. 6 is an enlarged cross-sectional view showing the main portion of the first embodiment whose valve is opened upward.

As a result of sucking so as to drink the beverage by putting one's mouth over the drinking mouth 15A, a negative pressure is resulted in the fluid passage 21, thus causing a pressure Pu above the membrane 32 to become smaller than a pressure Pd therebelow in the fluid passage 21. That is, as shown in FIG. 4 and FIG. 5, the valve-divided sections 37 are so provided that they will point upward in response to a pressure difference ($\Delta P = Pu - Pd$). As a result, an aperture 39 will be formed in the cut 36 that used to be closed, thereby causing the membrane 32 to be opened, thus allowing the content fluid to rise from the lower edge 31E along the fluid passage 21, and then pass through the aperture 39 before arriving at the drinking mouth portion 15. Further, as the aforementioned pressure difference becomes larger, the joining cylindrical portion 33 will point upward in a manner shown in FIG. 6, thereby allowing the aperture 39 to be formed among the valve-divided sections 37 and a valve-opened state to be maintained.

When the lid 7 is remaining opened in the aforementioned manner, a pressure due to a an increasing pressure in the container main body 2 and a displacement of the content fluid, is smaller than a load applied at the time of performing suction by putting one's mouth over the drinking mouth 15A. Therefore, a closed state of the membrane 32 can be maintained, thus preventing the content fluid from splashing from the drinking mouth 15A at the time of opening the lid 7.

Here, since the valve unit 20 is made of an elastic member, the cylindrical portion 31 can be brought into close contact with the inner bottom section 34, thus making it possible to reduce the size of a clearance between the cylindrical portion 31 and the inner bottom section 34. Accordingly, since the cut-out section 40 that communicates the fluid passage 21 and the outer side with each other is provided on the lower edge 31E of the cylindrical portion 31, one can drink up the content fluid by sucking the corresponding content fluid into the fluid passage 21 through the cut-out section 40, even when a small amount of the content fluid is remaining in the inner bottom section 34.

Figure 2:
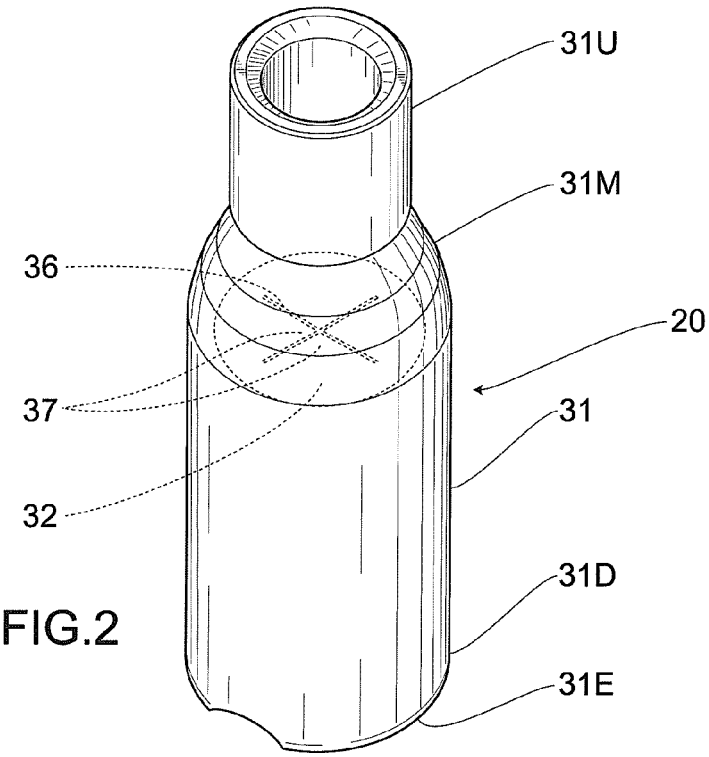
FIG. 2 is an enlarged perspective view showing a main portion of the first embodiment whose valve is closed.
Figure 3:
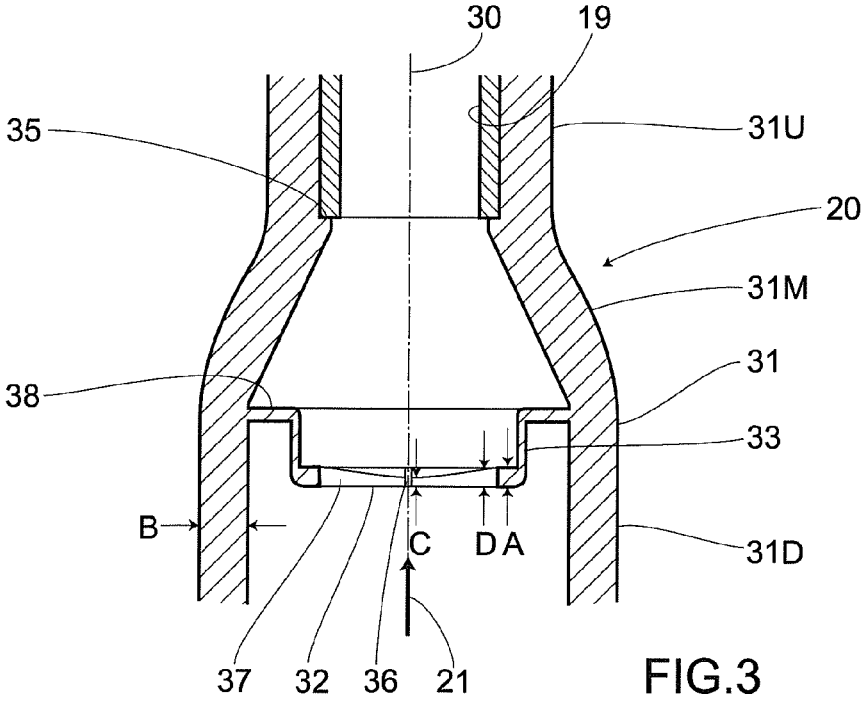
FIG. 3 is an enlarged cross-sectional view showing the main portion of the first embodiment whose valve is closed.

In contrast, once one's mouth has been removed from the drinking mouth 15A, the pressure difference will no longer be present, thereby allowing the valve-divided sections 37 and the joining cylindrical portion 33 to be restored to a state, i.e., valve-closed state shown in FIG. 2 and FIG. 3, through the restorabilities of the elastic materials. At that time, the membrane 32 is actually slightly opened due to a weight of the beverage still remaining in the drinking mouth portion 15 and the cylindrical main body 19. That is, the membrane 32 will be closed after a water level of the beverage remaining even in a front edge of the drinking mouth portion 15 has gone down. Therefore, a sealed state can be established by closing the lid 7 and bending the drinking mouth portion 15 accordingly.

The valve unit 20 can be washed as follows. That is, the cylindrical portion 31 of the valve unit 20 can be removed from the cylindrical main body 19 and then washed, followed by reattaching the valve unit 20 to the cylindrical main body 19 in a manner such that the lower edge 31E of the cylindrical portion 31 comes into close contact with the inner bottom section 34. Here, with regard to the cylindrical portion 31 of the valve unit 20, since the diameter of the upper section 31U is formed smaller than that of the lower section 31D, only the upper section 31U is allowed to fit onto the cylindrical main body 19, thus preventing the valve unit 20 from being attached upside down.

In the aforementioned embodiment, the drinking mouth portion 15 pointing upward is provided on the plug body 4 of the container main body 2 having the sealed structure. Further, the beverage cylindrical member 16 extending downward is built into the container main body 2 in a manner such that a front edge side thereof is communicated with the drinking mouth portion 15. Furthermore, the membrane 32 is provided in the fluid passage 21 of the beverage cylindrical member 16, the membrane 32 moving in accordance with the pressure difference in the corresponding fluid passage 21. That is, the membrane 32 is not manually opened and closed, but is configured to be able to react to a suction force occurring in the fluid passage 21. Therefore, only a relatively small number of additional parts are needed to solve a problem such as the spewing of the content fluid that occurs at the time of opening the drinking mouth 15A.

In addition, the positioning step section 35 having a smaller diameter is provided in the cylindrical portion 31 of the valve unit 20 equipped with the membrane 32. Specifically, the positioning step section 35 is disposed in a portion allowing the cylindrical main body 19 to engage therewith. That is, the positioning step section 35 allows the cylindrical main body 19 being inserted into the cylindrical portion 31 to be precisely positioned thereto, without causing the corresponding cylindrical main body 19 to be excessively inserted into the cylindrical portion 31.

Moreover, although the clearance between the lower edge 31E of the cylindrical portion 31 and the inner bottom section 34 needs to be formed as small as possible such that one can drink up the content fluid remaining in the inner bottom section 34, it is still possible that the lower edge 31E may come into contact with the inner bottom section 34 due to variations in parts. Even in such case, the up-pointing cut-out section 40 provided on the lower edge 31E allows one to drink up the content fluid through a simple structure.

Further, since the valve used in the present embodiment is the membrane 32 that closes the fluid passage 21, reacts to the pressure difference and has the cut 36 formed thereon, the valve can promptly respond to the pressure difference in the fluid passage 21.

Furthermore, with regard to the cylindrical portion 31, while the upper section 31U has the smaller diameter, the lower section 31D has the larger diameter. Therefore, it is possible to visually recognize a vertical direction of the cylindrical portion 31 when attaching the cylindrical main body 19 to the cylindrical portion 31, thus eliminating the possibility of carrying out the aforementioned attachment in a wrong direction.

Furthermore, the membrane (membrane valve) 32 of the valve unit (valve member) 20 is configured into the concave shape when joined to the beverage cylindrical member 16, and the cut 36 is formed in a concaved section of such membrane 32. Therefore, the membrane (membrane valve) 32 when configured into the concave shape is stronger against a pressure applied, thus making it difficult for the beverage to spew out.

Furthermore, since the joining cylindrical portion (connector sleeve) 33 is provided between the inner circumference of the cylindrical portion 31 and the outer edge of the membrane 32, a large-scale deformation from a concave shape to a convex shape is now possible, thereby making it possible to deal with larger pressure differences, thus preventing the membrane 32 from being deformed and/or damaged.

Second Embodiment

Other embodiments of the present invention are described hereunder. Here, elements identical to those of the first embodiment are marked with identical numerical symbols, and the descriptions thereof are thereby omitted.

Figure 7:
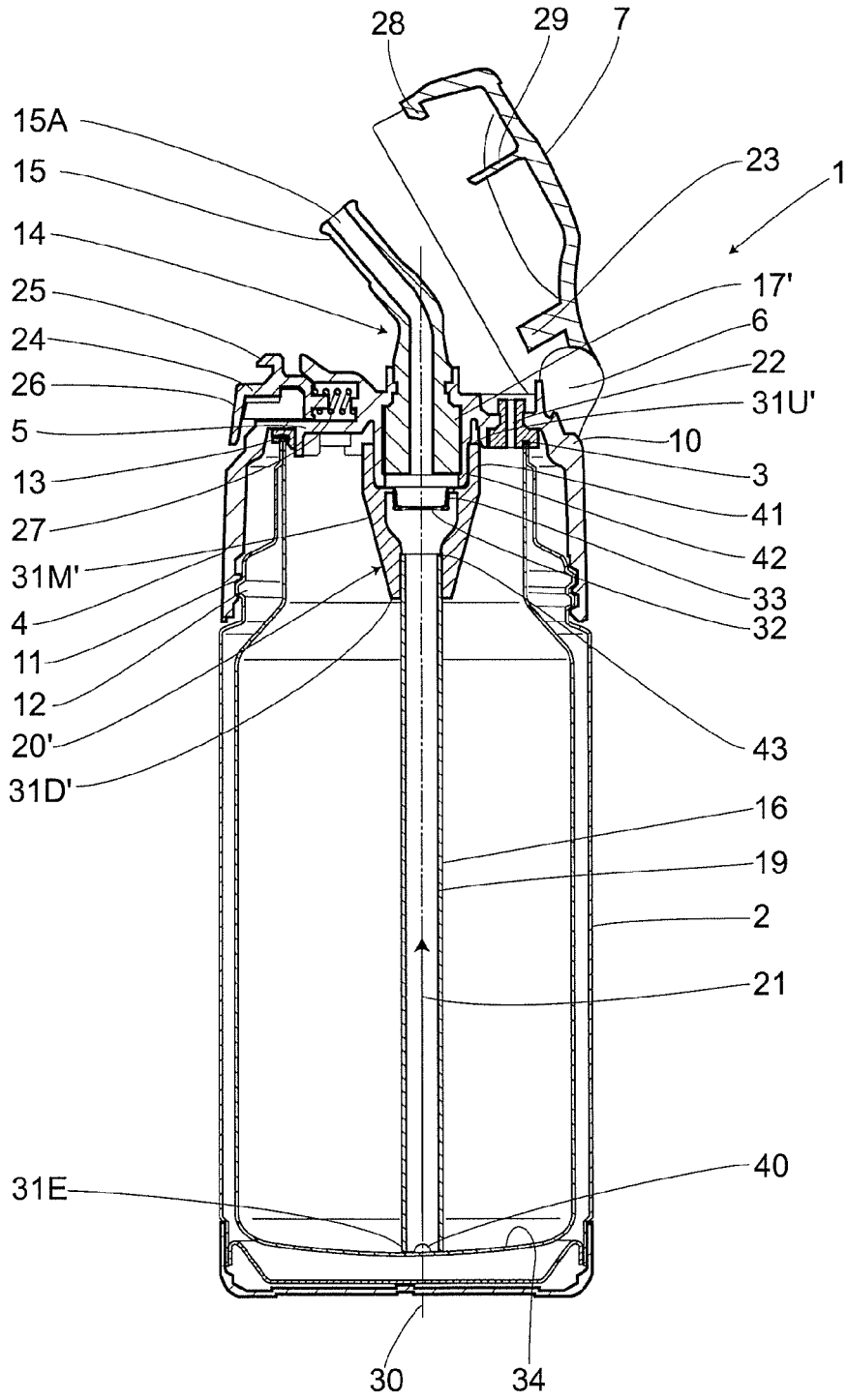
FIG. 7 is a vertical cross-sectional view showing a second embodiment of the present invention.
Figure 8:
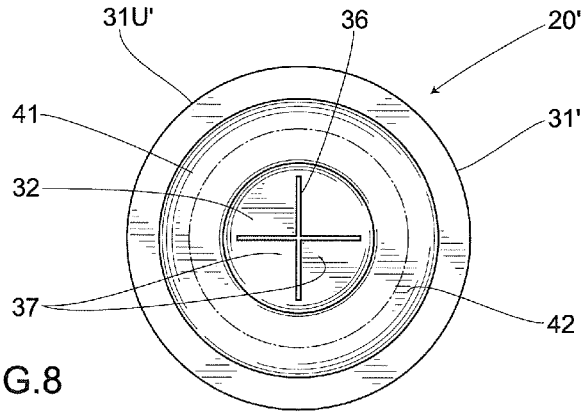
FIG. 8 is an enlarged plane view showing a main portion of the second embodiment.
Figure 9:
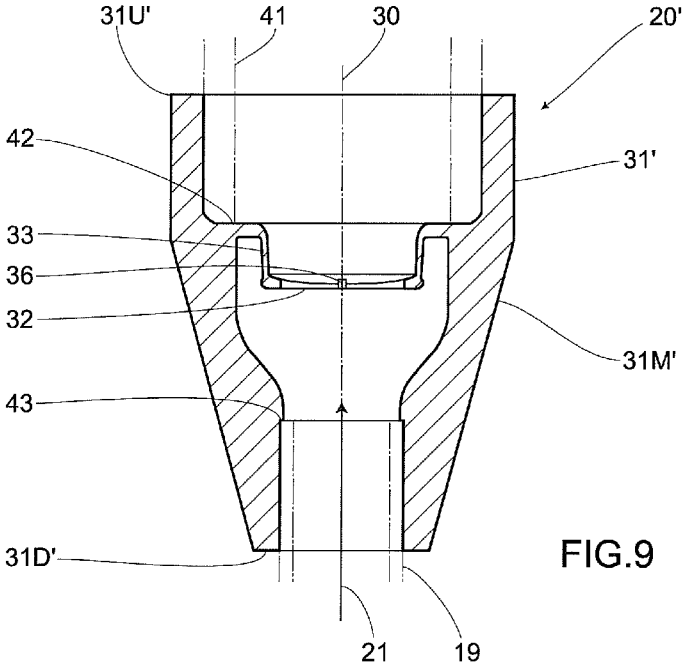
FIG. 9 is an enlarged cross-sectional view showing the main portion of the second embodiment.

A second embodiment is shown in FIG. 7 through FIG. 9. A positioning section 17' is provided on the base side of the drinking mouth portion 15, i.e., an under surface side of the plug body 4. The cylindrical main body 19 pointing downward is then joined to the positioning section 17' through a valve unit 20'. In the present embodiment, a cylindrical portion 41 pointing downward is provided between the positioning section 17' and a cylindrical portion 31' of the valve unit 20'. Further, the cylindrical portion 41 is integrally provided on the plug body 4.

With regard to an outer circumference of the cylindrical portion 31', while an upper section 31U' has a larger diameter, a lower end 31D' has a smaller diameter. Particularly, the cylindrical portion 31' is so formed that the diameter thereof gradually shrinks downward from an intermediate section 31M' to the lower end 31D'. Further, an upper positioning step section 42 is formed between the membrane 32 of the valve unit 20' and an upper-end opening section of the fluid passage 21, the upper positioning step section 42 serving as a positioning section when engaging the cylindrical portion 41 therewith. Similarly, a lower positioning step section 43 is formed between the membrane 32 and a lower-end opening section of the fluid passage 21, the lower positioning step section 43 serving as a positioning section when engaging the cylindrical main body 19 therewith.

Accordingly, as a result of performing suction by putting one's mouth over the drinking mouth 15A, the valve-divided sections 37 will open in response to the pressure difference inside the fluid passage 21. Here, the valve unit 20' is washed as follows. That is, the cylindrical portion 31' is removed and washed, followed by reattaching the valve unit 20'. At that time, with regard to the cylindrical portion 31' of the valve unit 20', the diameter of the upper section 31U' is larger than that of the lower end 31D', thereby allowing a condition of attachment to be visually distinguished, thus preventing the valve unit 20' from being attached upside down.

As mentioned above, the present embodiment brings about the effects similar to those of the first embodiment. In addition, with regard to the cylindrical portion 31', the diameter of the upper section 31U' is formed larger than that of the lower end 31D', thereby allowing a vertical direction to be visually recognized when attaching the valve unit 20', thus eliminating the possibility of carrying out the aforementioned attachment in a wrong direction. Further, the upper positioning step section 42 and the lower positioning step section 43 allow the valve unit 20' to be precisely positioned and attached to a positioning section 17' side, i.e., the cylindrical main body 19 and the cylindrical portion 41 in the present embodiment.

Thus, the beverage container of the present invention can be used for various purposes.

What is claimed:

1. A beverage container comprising:

a container main body having a container opening;

a plug body joined to the container opening of said container main body, said plug body being provided with an aeration portion;

an openable lid connected to said plug body by a hinge member attached to one end side of a top section of said plug body;

a drinking nozzle portion provided on said plug body, said drinking nozzle portion having a drinking nozzle at an end section and being made of an elastic material;

a beverage tube member provided below said drinking nozzle portion; and a valve unit detachably joined to a lower end of said beverage tube member and disposed in the container main body when said plug body is joined to the container opening of said container main body, said valve unit being made of an elastic material and including:

a cylindrical portion;

a flange section provided in said cylindrical portion;

a joining cylindrical portion having an upper end joined to an inner circumference of said flange section, said joining cylindrical portion extending downward;

a membrane joined to a lower end of said joining cylindrical portion, said membrane having cuts arranged radially thereon; and a cut-out section provided on a lower edge of the cylindrical portion, said cut-out section extending upward from the bottom of the cylindrical portion.

2. The beverage container according to claim 1, wherein said valve unit includes a positioning step section in a portion where a lower end of a cylindrical main body of said beverage tube member is allowed to engage therewith.

3. The beverage container according to claim 2, wherein said cylindrical portion is configured to come in close contact with an inner bottom section of said container main body.

4. The beverage container according to claim 2, wherein a thickness of said membrane is formed gradually smaller toward a central portion of said membrane.

5. The beverage container according to claim 1, wherein said membrane is integrally formed together with said cylindrical portion, said flange section and said joining cylindrical portion.

6. The beverage container according to claim 5, wherein an outer diameter of a lower section of said cylindrical portion is formed larger than an outer diameter of an upper section thereof.

7. The beverage container according to claim 1, wherein an outer diameter of a lower section of said cylindrical portion is formed larger than an outer diameter of an upper section thereof.

8. The beverage container according to claim 1, wherein said cylindrical portion is configured to come in close contact with an inner bottom section of said container main body.

9. The beverage container according to claim 1, wherein a thickness of said membrane is formed gradually smaller toward a central portion of said membrane.

10. The beverage container according to claim 1, wherein the drinking nozzle portion is bent into an "S" shape by a plate-shaped protrusion extending downward from a rear surface of the openable lid, when the openable lid is in the closed state.

* * * * *